US008978323B1

(12) United States Patent
Inzeo

(10) Patent No.: US 8,978,323 B1
(45) Date of Patent: Mar. 17, 2015

(54) PITCH ADJUSTABLE RIDGE VENTILATOR

(71) Applicant: Joseph A. Inzeo, West Allis, WI (US)

(72) Inventor: Joseph A. Inzeo, West Allis, WI (US)

(73) Assignee: Metal-Era, Inc., Waukesha, WI (US)

( * ) Notice: Subject to any disclaimer, the term of this patent is extended or adjusted under 35 U.S.C. 154(b) by 0 days.

(21) Appl. No.: 14/255,985

(22) Filed: Apr. 18, 2014

Related U.S. Application Data

(60) Provisional application No. 61/820,736, filed on May 8, 2013.

(51) Int. Cl.

| | |
|---|---|
| ***E04B 7/00*** | (2006.01) |
| ***E04H 12/28*** | (2006.01) |
| ***E04D 13/17*** | (2006.01) |
| ***E04D 13/147*** | (2006.01) |
| *F24F 7/02* | (2006.01) |

(52) U.S. Cl.

CPC ..... *E04D 13/174* (2013.01); *F24F 7/02* (2013.01); *E04D 13/178* (2013.01); *E04D 13/1473* (2013.01); *E04D 13/1471* (2013.01)

USPC ..... 52/199; 52/57; 52/198; 52/60; 52/96; 52/302.3; 454/365; 454/367; 454/260

(58) Field of Classification Search

CPC ..... E04D 13/1473; E04D 13/143; E04D 13/1471; E04D 13/174; E04D 13/178; F24F 7/02

USPC ..... 52/58, 57, 94, 95, 96, 198, 199, 60, 52/302.1, 302.3; 454/365, 260, 366, 367

See application file for complete search history.

(56) References Cited

U.S. PATENT DOCUMENTS

| | | | | |
|---|---|---|---|---|
| 2,704,500 | A | 3/1955 | Bonforte | |
| 3,073,235 | A | 1/1963 | Smith et al. | |
| 5,603,657 | A * | 2/1997 | Sells | 454/359 |
| 5,605,022 | A * | 2/1997 | Fulton | 52/199 |
| 6,128,870 | A * | 10/2000 | Kohler | 52/199 |
| 6,491,581 | B1 * | 12/2002 | Mankowski | 454/365 |
| 6,662,509 | B2 * | 12/2003 | Sharp et al. | 52/199 |
| 6,662,510 | B2 * | 12/2003 | Rotter | 52/199 |
| 7,024,829 | B2 * | 4/2006 | Sharp et al. | 52/199 |
| 7,393,273 | B2 * | 7/2008 | Ehrman et al. | 454/365 |
| 7,594,363 | B2 * | 9/2009 | Polumbus et al. | 52/199 |
| 7,823,343 | B1 * | 11/2010 | Inzeo | 52/198 |

* cited by examiner

*Primary Examiner* — Chi Q Nguyen
(74) *Attorney, Agent, or Firm* — Donald J. Ersler

(57) ABSTRACT

A pitch adjustable ridge ventilator preferably includes a plurality of adjustable pitch members, a pair of perforated members, a pair of perforated support members and a pair of U-shaped drip members. The adjustable pitch members are bendable to a particular angle. A first perforated support member is attached to a bottom of a first perforated member and a first side of the plurality adjustable pitch members. A second perforated support member is attached to a bottom of a second perforated member and a second side of the plurality adjustable pitch members. The first and second perforated support members are attached to a roof. Roof sheathing is attached to a top of the plurality of adjustable pitch members. A U-shaped drip member is attached over the roof sheathing and located under the perforated member. Each end of the pitch adjustable ridge ventilator is terminated with an end plate.

20 Claims, 9 Drawing Sheets

PITCH ADJUSTABLE RIDGE VENTILATOR

CROSS-REFERENCES TO RELATED APPLICATIONS

This is a utility patent application taking priority from provisional application No. 61/820,736 filed on May 8, 2013.

BACKGROUND OF THE INVENTION

1. Field of the Invention

The present invention relates generally to ventilation of buildings and more specifically to a pitch adjustable ridge ventilator, which may be adapted for use on roofs having different pitch angles.

2. Discussion of the Prior Art

Proper ventilation of a roof prevents premature failure of roofing materials (such as shingles) due to excessive heat; moisture due to condensation, thus preventing a major source of mold and mildew; and ice damming in cold climates, which also leads to premature failure of roofing materials. Some of the factors that dictate ventilation requirements include roof size, attic space area, length of roof ridge, length of roof eaves, pitch of roof, the amount of insulation below the roof, exposure to sun, climate, humidity and temperature extremes.

U.S. Pat. No. 2,704,500 to Bonforte discloses a ventilated ridge roll. U.S. Pat. No. 3,073,235 to Smith et al. discloses roof ventilators. However, the prior art does not teach or suggest a ridge ventilator, which is specifically designed to be modified for roofs having different pitch angles.

Accordingly, there is a clearly felt need in the art for a pitch adjustable ridge ventilator, which includes elements that may be angularly adjusted to fit the pitch of roofs having different pitch angles.

SUMMARY OF THE INVENTION

The present invention provides a pitch adjustable ridge ventilator, which may be adapted for use on roofs having different pitch angles. The pitch adjustable ridge ventilator preferably includes a plurality of adjustable pitch members, a pair of perforated members, a pair of perforated support members and a pair of U-shaped drip members. Each adjustable pitch member includes a bottom flange, a vertical support and a top flange. The bottom flange extends outward from a bottom of the vertical support in one direction and the top flange preferably extends outward from a top of the vertical support in an opposite direction. The bottom flange and the vertical support include a slit in a middle thereof to allow an included angle of the adjustable pitch member to be adjusted to fit different pitch roofs. Each perforated member preferably includes a perforated plate, a turned-up end and a turned-down end. One end of the perforated plate is bent-up to create an acute angle with the perforated plate to form the turned-up end. The other end is bent-down to be substantially perpendicular with the perforated plate to form the turned-down end.

A second embodiment of the adjustable pitch member includes a pair of bottom flanges, a vertical support, a top flange and a pair of middle flanges. The bottom flange extends outward from a bottom of the vertical support in one direction and the top flange preferably extends outward from a top of the vertical support in an opposite direction. The pair of middle flanges are formed in substantially a middle of a height of the vertical support and at each end thereof. The pair of middle flanges extend outward from the vertical member. A slit is formed in a middle of the vertical support to allow an included angle of the second embodiment of the adjustable pitch member to be adjusted to fit different pitch roofs.

Each perforated support member includes a bottom support flange, a vertical support member and a top support flange. The bottom support flange extends outward from a bottom of the vertical support member in one direction and the top support flange preferably extends outward from a top of the vertical support member in an opposite direction. The plurality of adjustable pitch members, the pair of perforated members, and the pair of perforated support members are preferably attached to each other with mechanical clinching, but other methods may also be used to form a vent support assembly. Each U-shaped drip member preferably includes an angled plate, a bottom lip and a top fastening flange. The bottom lip extends inward from a bottom of the angled plate at an acute angle. The top fastening flange extends inward from a top of the angled plate at an obtuse angle.

The pitch adjustable ridge ventilator is preferably installed in the following manner. A ventilation opening is formed in a ridge of a roof. A bottom support flange of a first perforated support member is attached to a first side of the ventilation slot with a plurality of fasteners and a bottom support flange of a second perforated support member is attached to a second side of the ventilation slot with the plurality of fasteners. The roof sheathing is attached to a top of the top flanges of the adjustable pitch members with a plurality of roof fasteners. The top fastening flanges of the pair of drip members are placed over an end of the roof sheathing and the bottom lips are placed under the ends of the perforated members. A plurality of sheathing fasteners are used to attach the top fastening flanges to the roof sheathing. Each end of the pitch adjustable ridge ventilator is terminated with an end plate. Shingles are attached to a top of the roof sheathing.

Accordingly, it is an object of the present invention to provide a pitch adjustable ridge ventilator, which includes elements that may be angularly adjusted to fit the pitch of roofs having different pitch angles.

These and additional objects, advantages, features and benefits of the present invention will become apparent from the following specification.

DETAILED DESCRIPTION OF THE PREFERRED EMBODIMENTS

Figure 1:
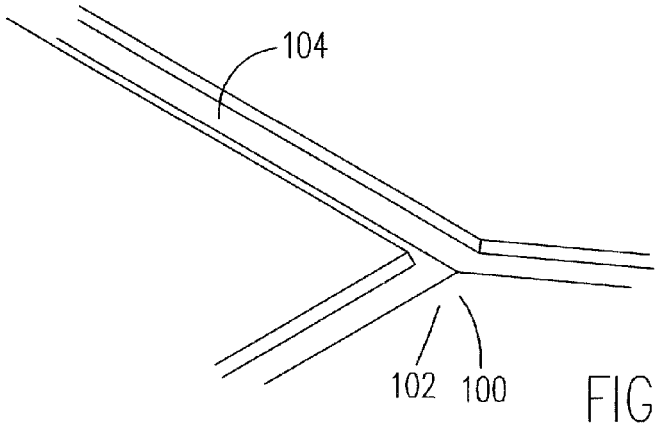
FIG. 1 is a perspective view of a roof with a ventilation opening for attachment of a pitch adjustable ridge ventilator in accordance with the present invention.
Figure 2:
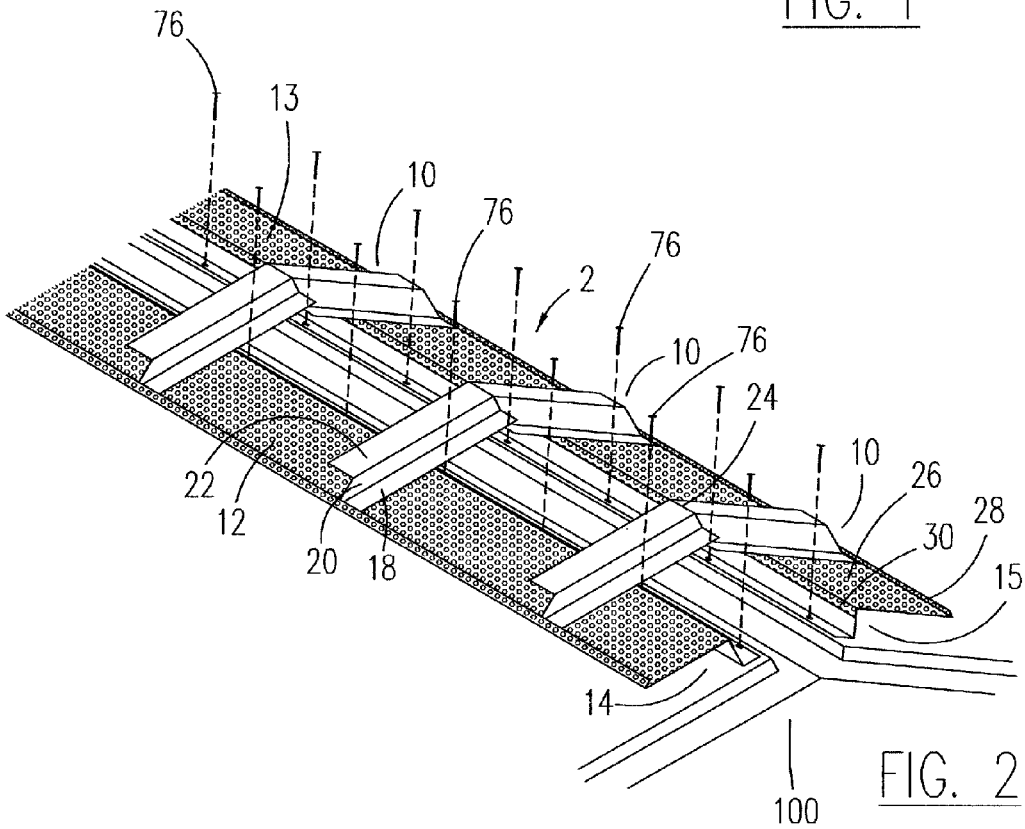
FIG. 2 is a perspective view of a vent support assembly of a pitch adjustable ridge ventilator before attachment to a roof in accordance with the present invention.
Figure 3:
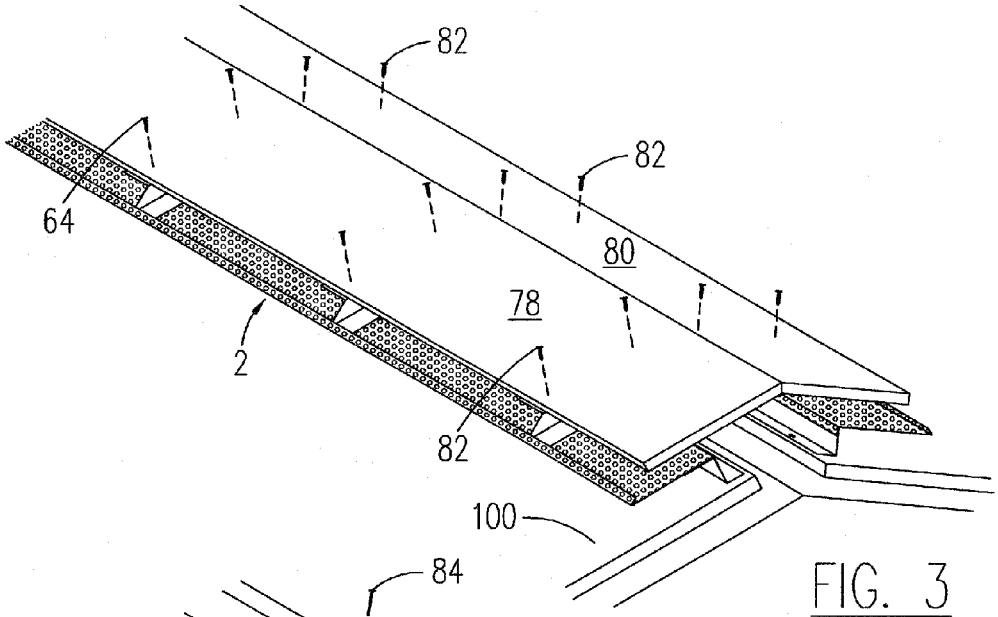
FIG. 3 is a perspective view of roof sheathing before attachment to top flanges of a plurality adjustable pitch members of a pitch adjustable ridge ventilator in accordance with the present invention.
Figure 4:
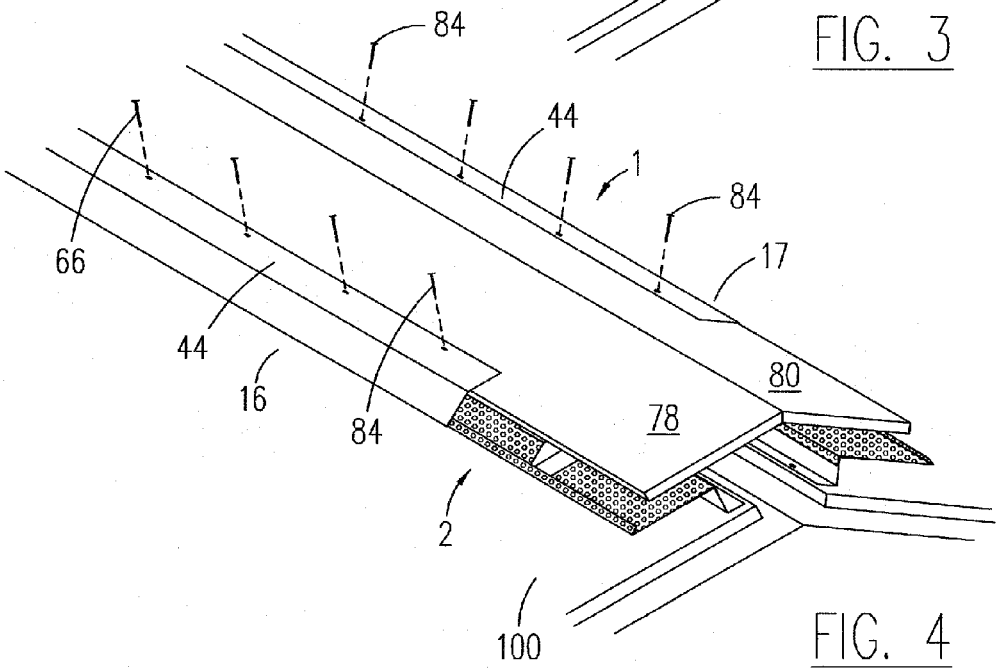
FIG. 4 is a perspective view of a pair of U-shaped drip members before attachment to ends of roof sheathing of a pitch adjustable ridge ventilator in accordance with the present invention.
Figure 11:
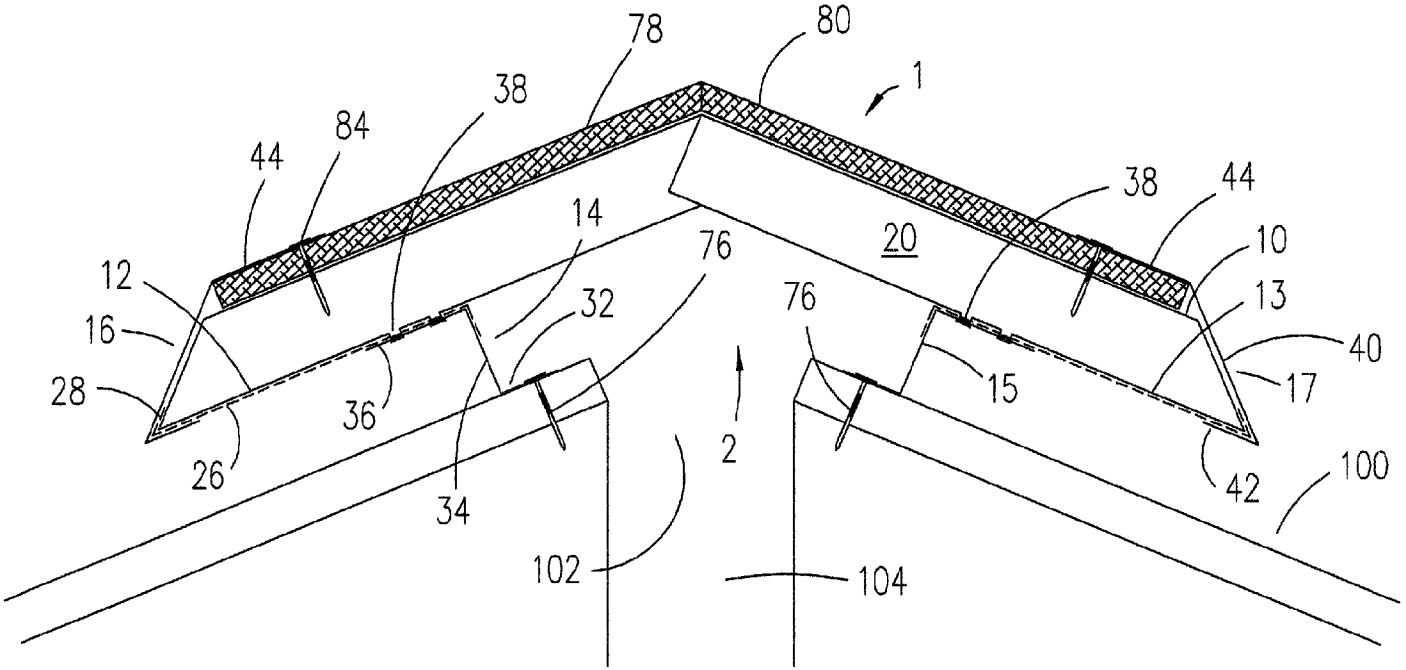
FIG. 11 is an end view of a pitch adjustable ridge ventilator attached to a roof in accordance with the present invention.

With reference now to the drawings, and particularly to FIG. 11, there is shown an end view of a pitch adjustable ridge ventilator 1. With reference to FIGS. 1 and 11, a ventilation opening 104 for attachment of a pitch adjustable ridge ventilator 1 is formed in a ridge 102 of a roof 100. With reference to FIGS. 2-4, the pitch adjustable ridge ventilator 1 preferably includes a plurality of adjustable pitch members 10, a pair of perforated members 12, 13, a pair of perforated support members 14, 15 and a pair of U-shaped drip members 16, 17. Each adjustable pitch member 10 includes a bottom flange 18, a vertical support 20 and a top flange 22. The bottom flange 18 extends outward from a bottom of the vertical support 20 in one direction and the top flange 22 preferably extends outward from a top of the vertical support 20 in an opposite direction. The bottom flange 18 and the vertical support 20 include a slit in a middle thereof to allow an included angle of the plurality of adjustable pitch members 10 to be adjusted to fit roofs with different pitch angles. A living hinge 24 is created in a middle of the top flange 22.

Each perforated member 12, 13 preferably includes a perforated plate 26, a turned-up end 28 and a turned-down end 30. One end of the perforated plate 26 is bent-up to have an acute angle with the perforated plate 26 to form the turned-up end 28. An inside of the acute angle of the turned-up end 28 is sized to receive an end of the adjustable pitch member 10. The other end of the perforated plate 26 is bent-down to be substantially perpendicular with the perforated plate 26 to form the turned-down end 30. Each perforated support member 14, 15 includes a bottom support flange 32, a vertical support member 34 and a top support flange 36. The bottom support flange 32 extends outward from a bottom of the vertical support member 34 in one direction and the top support flange 36 preferably extends outward from a top of the vertical support member 14, 15 in an opposite direction. The plurality of adjustable pitch members 10, the pair of perforated members 12, 13 and the pair of perforated support members 14, 15 are preferably attached to each other with mechanical clinching 38, but other methods may also be used to form a vent support assembly 2.

Figure 6:
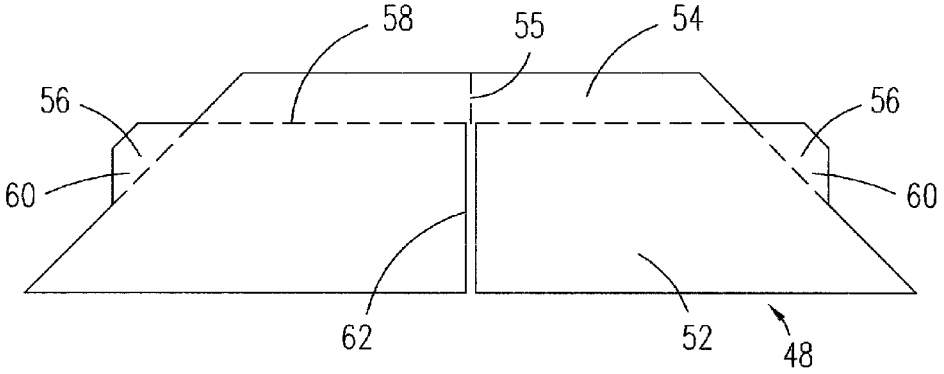
FIG. 6 is a front view of an unfolded top member of an end plate of a pitch adjustable ridge ventilator in accordance with the present invention.
Figure 7:
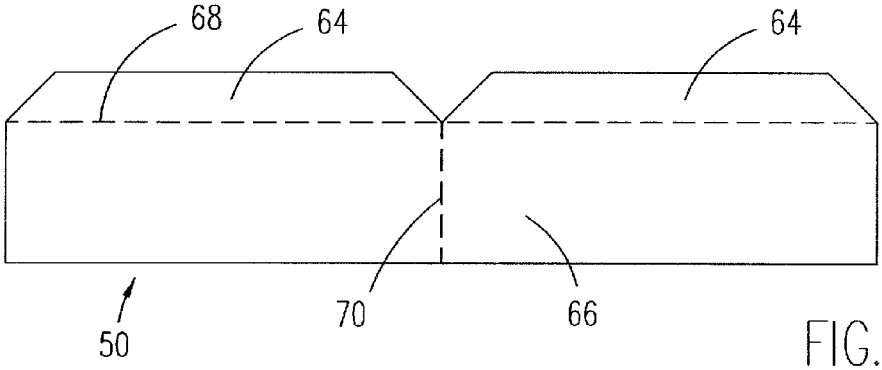
FIG. 7 is a front view of an unfolded bottom member of an end plate of a pitch adjustable ridge ventilator in accordance with the present invention.
Figure 8:
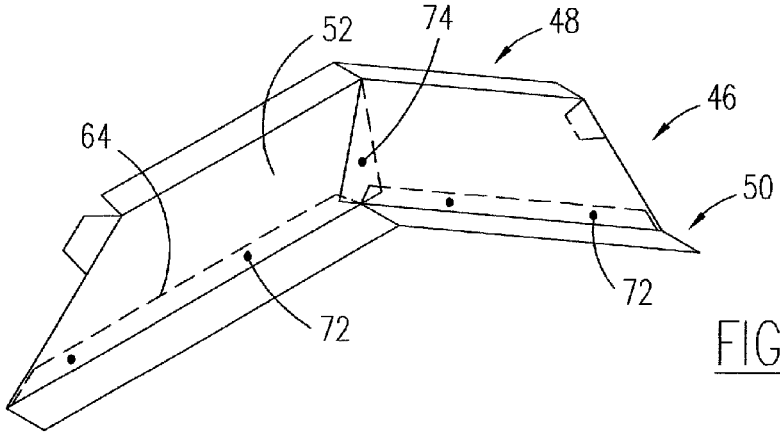
FIG. 8 is a perspective view of an end plate assembled from top and bottom portions of a pitch adjustable ridge ventilator in accordance with the present invention.
Figure 9:
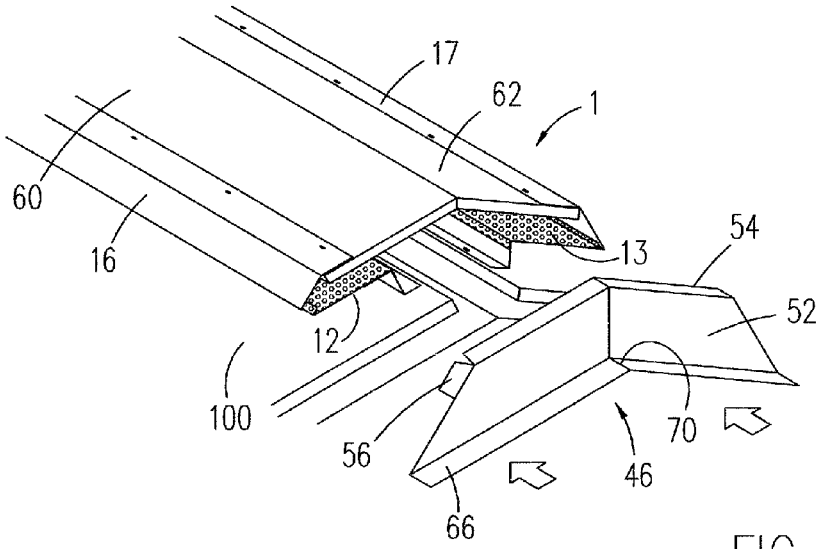
FIG. 9 is a partially exploded perspective view of an end plate before attachment to an end of a pitch adjustable ridge ventilator in accordance with the present invention.

Each U-shaped drip member 16, 17 includes an angled plate 40, a bottom lip 42 and a top fastening flange 44. The bottom lip 42 extends inward from a bottom of the angled plate 40 at an acute angle. The top fastening flange 44 extends inward from a top of the angled plate 40 at an obtuse angle. With reference to FIG. 9, an end plate 46 is used to seal ends of the pitch adjustable ridge ventilator 1. With reference to FIGS. 6-8, the end plate 46 preferably includes a top member 48 and a bottom member 50. The top member 48 includes a plate member 52, a top flange 54 and a pair of side end flanges 56. A top bend line 58 defines the plate member 52 and the top flange 54. Side bend lines 60 define the plate member 52 and the pair of side end flanges 56. A slit 62 is formed in a middle of the plate member 52. The top flange 54 and the pair of end flanges 56 are folded inward relative to the plate member 52. A top middle bend line 55 of the top flange 54 is folded to match the pitch angle of a roof.

The bottom member 50 includes at least two attachment flanges 64 and a bottom flange 66. A bottom bend line 68 defines the at least two attachment flanges 64 and the bottom flange 66. The bottom flange 66 is folded outward relative to the at least two attachment flanges 64. A bottom middle bend line 70 of the bottom flange 66 is folded to match the pitch angle of a roof. The top and bottom members 48, 50 are assembled to each other by attaching the at least two attachment flanges 64 to the end plate 52 with a plurality of rivets 72. A single rivet 74 is used to attach the end plate 52 to itself, after bending the top member 48 to the pitch angle of the roof.

With reference to FIGS. 1-5 and 11, the pitch adjustable ridge ventilator 1 is preferably installed in the following manner. The ventilation opening 104 is formed in the ridge 102 of the roof 100. The bottom support flange 32 of the first perforated support member 14 is attached to a first side of the ventilation slot 104 with a plurality of fasteners 76 and the bottom support flange 32 of the second perforated support member 15 is attached to a second side of the ventilation slot 104 with the plurality of fasteners 58. A first roof sheathing 78 is attached to a first side of the top flanges 22 of the plurality of adjustable pitch members 10 with a plurality of roof fasteners 82. A second roof sheathing 80 is attached to a second side of the top flanges 22 of the plurality of adjustable pitch members 10 with the plurality of roof fasteners 82. The first and second roof sheathing 78, 80 is preferably fabricated from oriented strand board (OSB), but other materials may also be used. However, the first and second roof sheathing 78, 80 is typically supplied by installing contractor.

Figure 5:
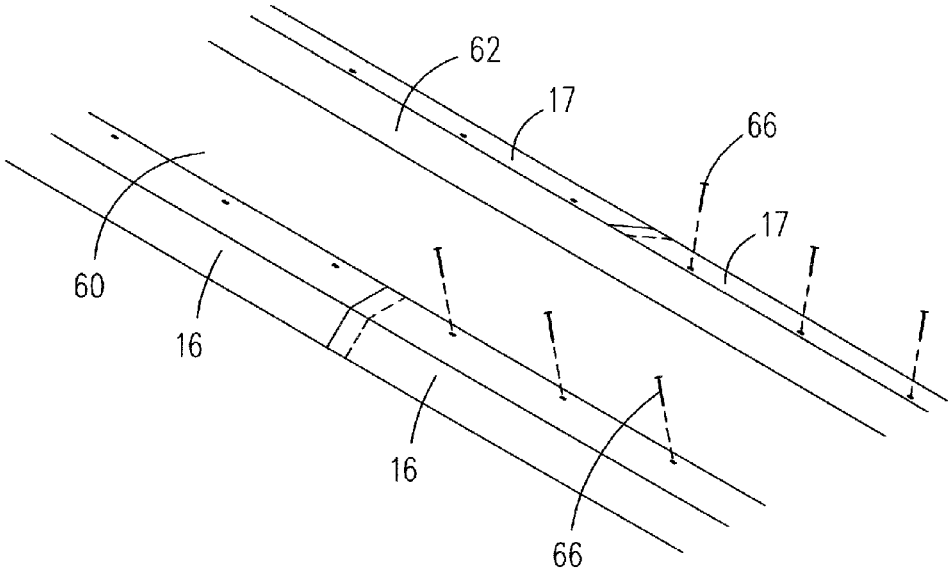
FIG. 5 is a perspective view of a second pair of U-shaped drip members being slipped under a first pair of U-shaped drip members and before attachment of the second pair of U-shaped drip members to roof sheathing of a pitch adjustable ridge ventilator in accordance with the present invention.

The top fastening flanges 44 of the pair of drip members 16, 17 are placed over an end of the roof sheathing 78, 80 and the bottom lips 42 are placed under the ends of the perforated members 12, 13, respectively. The top fastening flanges 44 of the pair of drip members 16, 17 are attached to the roof sheathing 78, 80 with a plurality of fasteners 84. With reference to FIG. 5, a length of the first and second U-shaped drip members 16, 17 are preferably spliced together by slipping one of two first U-shaped drip members 16 under an end of the other one of two first U-shaped drip members 16. One of two, second U-shaped drip members 17 is slipped under an end of the other one of two second U-shaped drip members 17.

Figure 10:
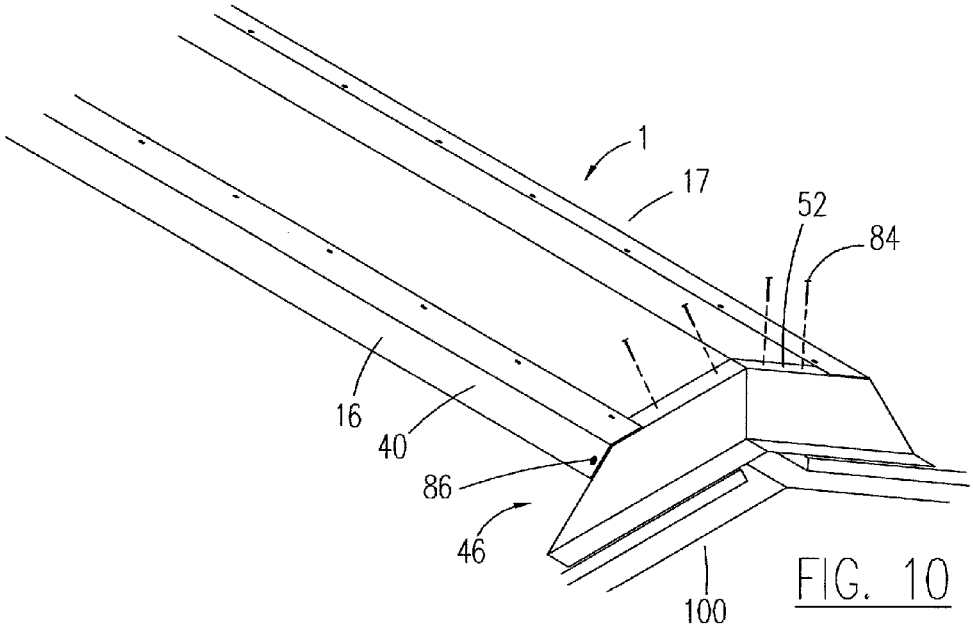
FIG. 10 is perspective view of an end plate before attachment to an end of a pitch adjustable ridge ventilator in accordance with the present invention.

With reference to FIG. 10, the end plate 46 is preferably attached to one end of the pitch adjustable ridge ventilator 1 by attaching the plurality of fasteners 84 through the at least one top flange 54 and the pair of roof sheathing 78, 80, and by attaching two fasteners 86 through the first and second angled plates 40 and the two side end flanges 56. Shingles are finally attached to a top of the roof sheathing 78, 80.

Figure 2A:
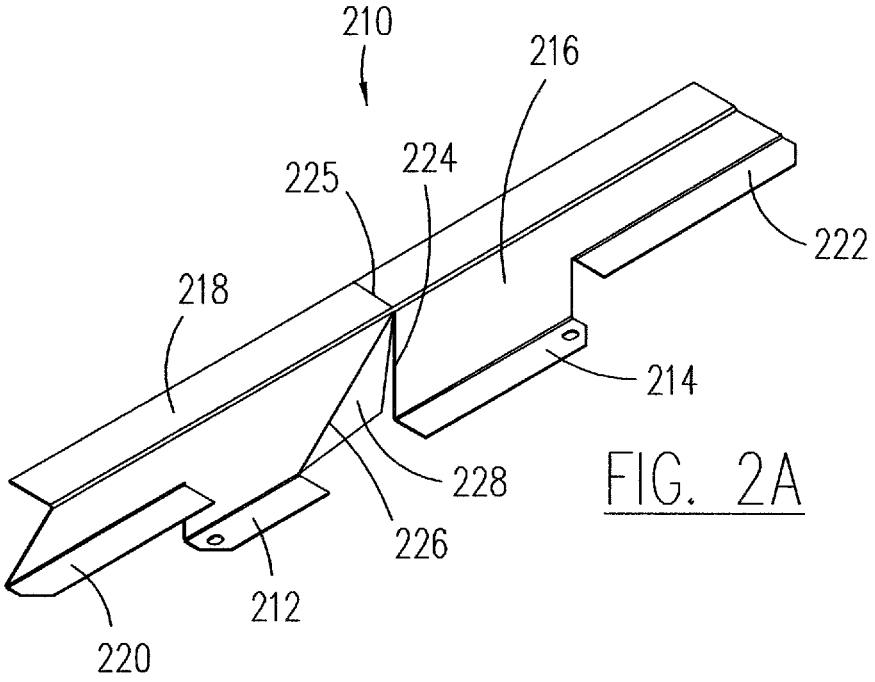
FIG. 2*a* is a perspective view of a second embodiment of an adjustable pitch member of a pitch adjustable ridge ventilator in accordance with the present invention.
Figure 2B:
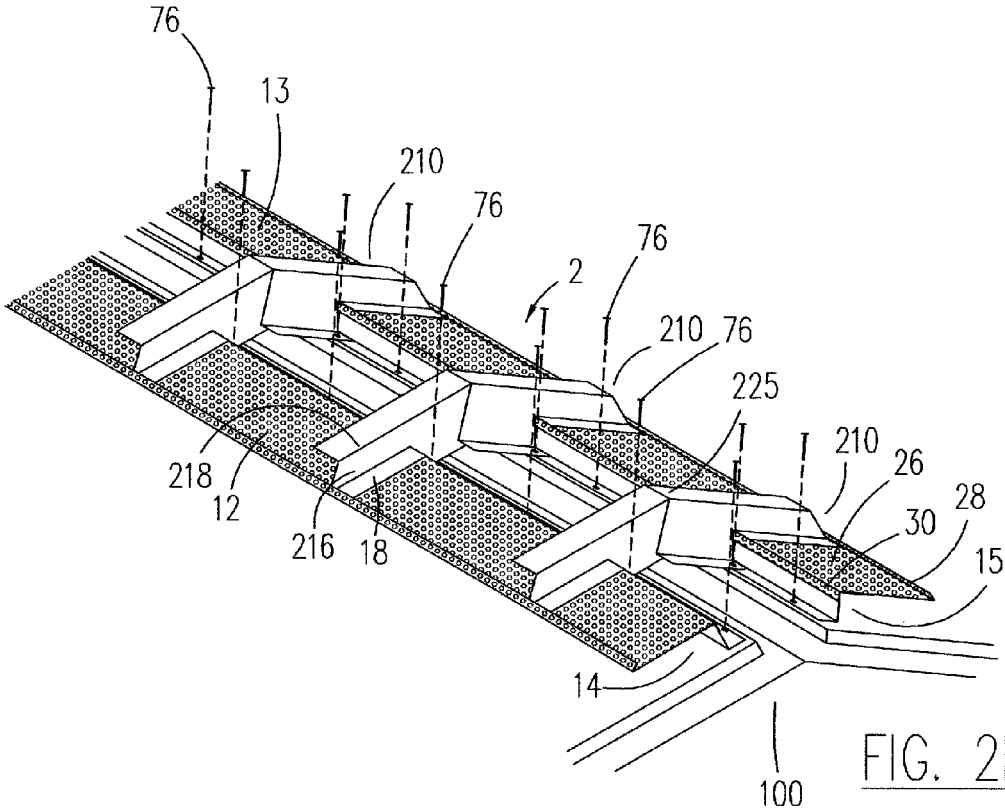
FIG. 2*b* is a perspective view of a vent support assembly utilizing a second embodiment of an adjustable pitch member of a pitch adjustable ridge ventilator, before attachment to a roof in accordance with the present invention.
Figure 11A:
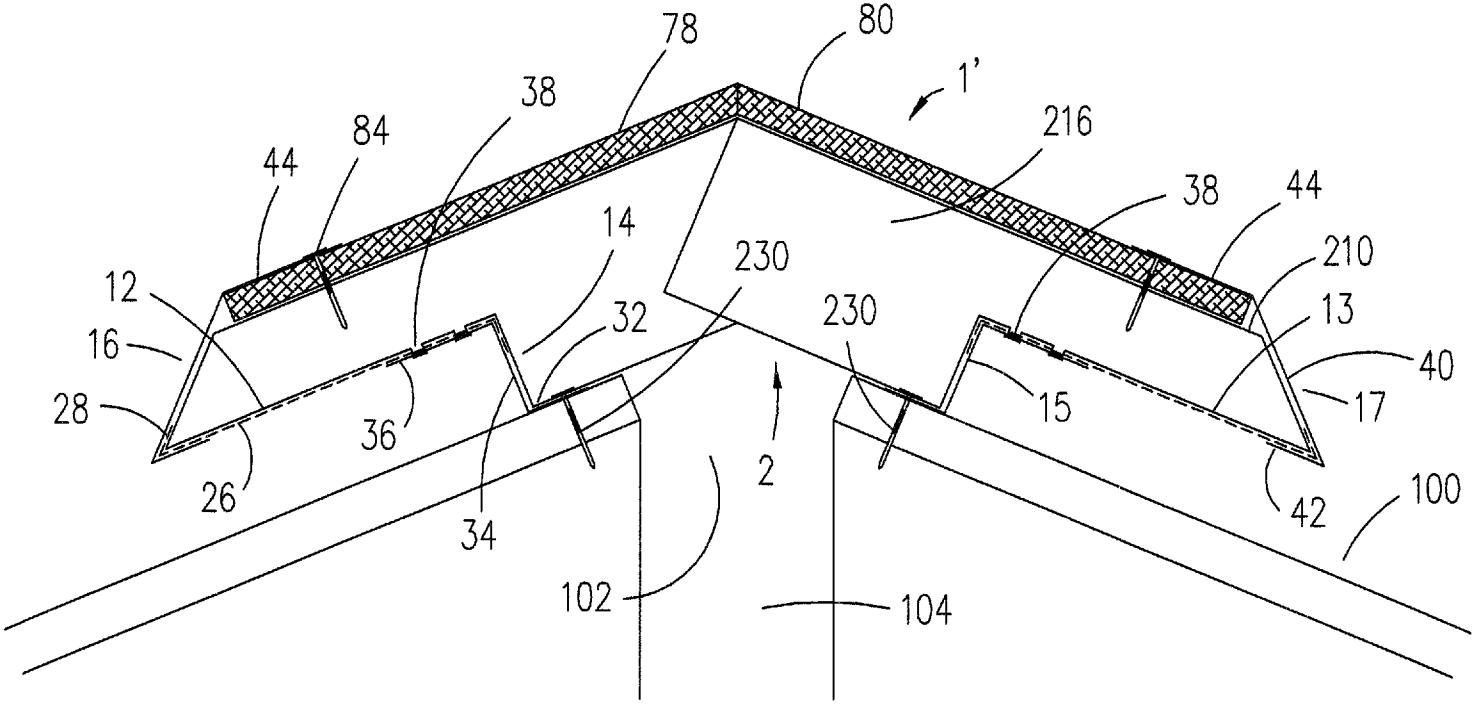
FIG. 11*a* is an end view of a pitch adjustable ridge ventilator with a second embodiment of an adjustable pitch member attached to a roof in accordance with the present invention.

With reference to FIG. 11*a*, a pitch adjustable ridge ventilator 1' includes the substitution of a plurality of adjustable pitch members 210 for the plurality of adjustable pitch members 10. With reference to FIG. 2*a*, each adjustable pitch member 210 includes a pair of bottom flanges 212, 214, a vertical support 216, a top flange 218 and a pair of middle flanges 220, 222. The pair of bottom flanges extend outward from a bottom of the vertical support 216 in one direction and the top flange 218 preferably extends outward from a top of the vertical support 216 in an opposite direction. The pair of middle flanges 220, 222 are formed in substantially a middle of a height of the vertical support 216 and at each end thereof. The pair of middle flanges extend outward from the vertical member. A slit 224 is formed in a middle of the vertical support 216 to allow an included angle of the adjustable pitch member 210 to be adjusted to fit roofs with different pitch angles. With reference to FIG. 2*b*, the included angle of the adjustable pitch member is changed by bending thereof at a living hinge 225. A bend line 226 is formed adjacent the slit 224 to create a bend panel 228. The bend panel 228 is bent inward to allow the change of the included angle. With reference to FIG. 11*a*, two fasteners 230 are inserted through the first and second middle flanges 212, 214 and anchored to the roof 100.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A pitch adjustable ridge ventilator comprising:

a plurality of adjustable pitch members, at least one of said plurality of adjustable pitch members includes a bottom flange and a top flange, a living hinge is formed in a middle of said top flange;

a first perforated member and a second perforated member; and a first perforated support member and a second perforated support member, each one of said first and second perforated supports includes a bottom support flange and a top support flange, said top support flange of said first perforated support member is attached to said first perforated member and said bottom flange of one of said plurality of adjustable pitch members on a first side of said living hinge, said top support flange of said second perforated support member is attached to said second perforated member and said bottom flange of one of said plurality of adjustable pitch members on a second side of said living hinge.

2. The pitch adjustable ridge ventilator of claim 1, further comprising:

a first roof sheathing is attached to said first side of said plurality of adjustable pitch members; and a second roof sheathing is attached to said second side of said plurality of adjustable pitch members.

3. The pitch adjustable ridge ventilator of claim 2, further comprising:

a first U-shaped drip member is slipped over the first roof sheathing and under said first perforated member; and a second U-shaped drip member is slipped over the second roof sheathing and under said second perforated member.

4. The pitch adjustable ridge ventilator of claim 3 wherein:

each U-shaped drip member includes an angled plate, a bottom lip and a top fastening flange, said bottom lip extends inward from a bottom of said angled plate at an acute angle, said top fastening flange extends inward from a top of said angled plate at an obtuse angle.

5. The pitch adjustable ridge ventilator of claim 1 wherein:

at least one of said plurality of adjustable pitch members includes a vertical support, said bottom flange extends from a bottom of said vertical support in one direction, said top flange extends from a top of said vertical support in an opposite direction, said bottom flange and said vertical support include a slit in a middle thereof.

6. The pitch adjustable ridge ventilator of claim 5 wherein:

a pair of middle flanges are formed in substantially a middle of said vertical support and at each end thereof, said pair of middle flanges extend outward from said vertical member.

7. The pitch adjustable ridge ventilator of claim 1 wherein:

said perforated support member includes a vertical support member, said bottom support flange extends outward from a bottom of said vertical support member in one direction, said top support flange extends outward from a top of said vertical support member in an opposite direction.

8. A pitch adjustable ridge ventilator comprising:

a plurality of adjustable pitch members, at least one of said plurality of adjustable pitch members includes a bottom flange and a top flange, a living hinge is formed in a middle of said top flange;

a first perforated member and a second perforated member; and a first perforated support member and a second perforated support member, each one of said first and second perforated supports includes a bottom support flange and a top support flange, said top support flange of said first perforated support member is attached to said first perforated member and said bottom flange of one of said plurality of adjustable pitch members on a first side of said living hinge, said top support flange of said second perforated support member is attached to said second perforated member and said bottom flange of one of said plurality of adjustable pitch members on a second side of said living hinge; and an end plate is attached to each end of said pitch adjustable ridge ventilator.

9. The pitch adjustable ridge ventilator of claim 8, further comprising:

a first roof sheathing is attached to said first side of said plurality of adjustable pitch members; and a second roof sheathing is attached to said second side of said plurality of adjustable pitch members.

10. The pitch adjustable ridge ventilator of claim 9, further comprising:

a first U-shaped drip member is slipped over the first roof sheathing and under said first perforated member; and a second U-shaped drip member is slipped over the second roof sheathing and under said second perforated member.

11. The pitch adjustable ridge ventilator of claim 10 wherein:

each U-shaped drip member includes an angled plate, a bottom lip and a top fastening flange, said bottom lip extends inward from a bottom of said angled plate at an acute angle, said top fastening flange extends inward from a top of said angled plate at an obtuse angle.

12. The pitch adjustable ridge ventilator of claim 11 wherein:

a pair of middle flanges are formed in substantially a middle of said vertical support and at each end thereof, said pair of middle flanges extend outward from said vertical member.

13. The pitch adjustable ridge ventilator of claim 8 wherein:

at least one of said plurality of adjustable pitch members includes a vertical support, said bottom flange extends from a bottom of said vertical support in one direction, said top flange extends from a top of said vertical support in an opposite direction, said bottom flange and said vertical support includes a slit in a middle thereof.

14. The pitch adjustable ridge ventilator of claim 8 wherein:

one of said first and second perforated members includes a perforated plate, a turned-up end and a turned-down end, one end of said perforated plate is bent-up to have an acute angle with said perforated plate to form said turned-up end, the other end of said perforated plate is bent-down to be substantially perpendicular with said perforated plate to form said turn-down end.

15. The pitch adjustable ridge ventilator of claim 8 wherein:

said end plate includes a top member and a bottom member, said top member includes a plate member and a top flange extending outward from a top of said plate member, a slit is formed in a middle of said plate member, a top middle bend line of said top flange is folded to match a pitch angle of the roof, said bottom member extends outward from a bottom of said plate member.

16. A pitch adjustable ridge ventilator comprising:

a plurality of adjustable pitch members, at least one of said plurality of adjustable pitch members includes a bottom flange a vertical support and a top flange, a living hinge is formed in a middle of said top flange, said bottom flange extends from a bottom of said vertical support in one direction, said top flange extends from a top of said vertical support in an opposite direction, said bottom flange and said vertical support include a slit in a middle thereof;

a first perforated member and a second perforated member; and a first perforated support member and a second perforated support member, each one of said first and second perforated supports includes a bottom support flange and a top support flange, said top support flange of said first perforated support member is attached to said first perforated member and said bottom flange of one of said plurality of adjustable pitch members on a first side of said living hinge, said top support flange of said second perforated support member is attached to said second perforated member and said bottom flange of one of said plurality of adjustable pitch members on a second side of said living hinge.

17. The pitch adjustable ridge ventilator of claim 16, further comprising:

a first roof sheathing is attached to said first side of said plurality of adjustable pitch members; and a second roof sheathing is attached to said second side of said plurality of adjustable pitch members.

18. The pitch adjustable ridge ventilator of claim 17, further comprising:

a first U-shaped drip member is slipped over the first roof sheathing and under said first perforated member; and a second U-shaped drip member is slipped over the second roof sheathing and under said second perforated member.

19. The pitch adjustable ridge ventilator of claim 16 wherein:

each one of said first and second perforated members includes a perforated plate, a turned-up end and a turned-down end, one end of said perforated plate is bent-up to have an acute angle with said perforated plate to form said turned-up end, the other end of said perforated plate is bent-down to be substantially perpendicular with said perforated plate to form said turn-down end.

20. The pitch adjustable ridge ventilator of claim 16 wherein:

a pair of middle flanges are formed in substantially a middle of said vertical support and at each end thereof, said pair of middle flanges extend outward from said vertical member.

* * * * *